US008991776B1

(12) United States Patent
DiMaggio

(10) Patent No.: US 8,991,776 B1
(45) Date of Patent: Mar. 31, 2015

(54) DISPLAY

(76) Inventor: Anthony DiMaggio, Walled Lake, MI (US)

( * ) Notice: Subject to any disclaimer, the term of this patent is extended or adjusted under 35 U.S.C. 154(b) by 640 days.

(21) Appl. No.: 11/120,708

(22) Filed: May 3, 2005

Related U.S. Application Data

(60) Provisional application No. 60/568,943, filed on May 6, 2004.

(51) Int. Cl.
*A47F 7/02* (2006.01)
*A47F 3/02* (2006.01)

(52) U.S. Cl.
CPC ..... *A47F 3/02* (2013.01)
USPC ..... 248/176.1; 248/246.03; 206/6.1; 211/85.2

(58) Field of Classification Search
USPC ..... 206/6.1, 477, 481, 482, 483, 566; 211/85.2; 248/222.12, 114, 115, 116, 248/146, 148, 225.11, 223.41, 469, 127, 248/346.01, 346.03, 176.1
See application file for complete search history.

(56) References Cited

U.S. PATENT DOCUMENTS

| | | | | | |
|---|---|---|---|---|---|
| 329,018 | A | | 10/1885 | Coffin | |
| 720,389 | A | * | 2/1903 | Young | 24/457 |
| 1,492,113 | A | * | 4/1924 | Welsh | 206/5 |
| 2,099,906 | A | * | 11/1937 | Reese et al. | 211/65 |
| 2,119,832 | A | * | 6/1938 | Schless | 206/562 |
| 2,235,283 | A | | 3/1941 | Carver | |
| 2,591,349 | A | | 4/1952 | Goebel | |
| 3,197,166 | A | * | 7/1965 | Sandler | 248/500 |
| 3,206,014 | A | * | 9/1965 | Blumberg | 206/6.1 |
| D209,357 | S | | 11/1967 | Semler | |
| 3,365,154 | A | | 1/1968 | Hofmann | |
| 3,452,663 | A | | 7/1969 | Machtig | |
| 3,460,282 | A | * | 8/1969 | Swirsky | 40/530 |
| D215,311 | S | * | 9/1969 | Born | D6/541 |
| 3,519,138 | A | * | 7/1970 | Murray | 211/85.1 |
| 3,525,493 | A | * | 8/1970 | Newell et al. | 248/220.21 |
| 3,564,668 | A | * | 2/1971 | Kirk | 281/30 |
| D221,617 | S | * | 8/1971 | D'Elia | D20/43 |
| 3,660,873 | A | * | 5/1972 | Kawashima | 248/222.12 |
| 3,724,799 | A | * | 4/1973 | Dotson | 248/450 |
| 3,787,922 | A | * | 1/1974 | Foy et al. | 16/404 |
| 3,807,675 | A | * | 4/1974 | Seckerson et al. | 248/73 |
| 3,822,849 | A | * | 7/1974 | Joyce | 248/450 |
| 4,001,444 | A | * | 1/1977 | Clarke | 426/110 |
| D243,658 | S | | 3/1977 | Schneider | |
| D254,317 | S | * | 2/1980 | Chicone | D19/75 |
| 4,193,198 | A | * | 3/1980 | Bauer | 433/77 |
| 4,341,300 | A | * | 7/1982 | Roy | 248/520 |
| 4,434,791 | A | * | 3/1984 | Darnell | 600/233 |
| 4,561,635 | A | * | 12/1985 | Lamansky | 254/26 R |
| 4,630,824 | A | * | 12/1986 | Sweet | 273/150 |
| 4,646,920 | A | * | 3/1987 | Kruger | 211/85.2 |
| 4,669,733 | A | * | 6/1987 | Sweet | 273/150 |
| 5,031,778 | A | | 7/1991 | Edgecombe | |
| 5,038,941 | A | * | 8/1991 | Bastiaansen | 211/32 |
| 5,062,526 | A | * | 11/1991 | Rudnick et al. | 206/6.1 |
| 5,188,325 | A | * | 2/1993 | Hilty et al. | 248/224.8 |
| D349,925 | S | * | 8/1994 | Charron et al. | D19/90 |
| D352,963 | S | * | 11/1994 | Siler | D19/83 |

(Continued)

*Primary Examiner* — David Fidei
(74) *Attorney, Agent, or Firm* — Howard & Howard Attorneys PLLC

(57) ABSTRACT

A display for holding and displaying an object includes a base and a projection extending from the base and having a slot to form a pair of branches. The branches are adapted to hold a portion of the object within the slot and to display the object.

15 Claims, 1 Drawing Sheet

(56) References Cited

U.S. PATENT DOCUMENTS

| | | | | | |
|---|---|---|---|---|---|
| 5,480,073 | A | * | 1/1996 | LaManna | 223/1 |
| 5,535,878 | A | * | 7/1996 | Reed | 206/6.1 |
| D379,410 | S | | 5/1997 | Porcaro | |
| 5,806,822 | A | * | 9/1998 | Schulz | 248/309.1 |
| 5,829,103 | A | * | 11/1998 | Allen | 24/11 R |
| 5,855,345 | A | | 1/1999 | DiMaggio | |
| D406,051 | S | * | 2/1999 | Ross | D8/395 |
| 5,913,417 | A | * | 6/1999 | Ovadia | 206/6.1 |
| 6,012,570 | A | * | 1/2000 | Ovadia et al. | 206/6.1 |
| D478,630 | S | * | 8/2003 | Riggins | D19/83 |
| 6,668,426 | B1 | * | 12/2003 | Morris | 24/3.3 |
| 6,682,025 | B2 | * | 1/2004 | Turner et al. | 248/65 |
| 6,932,212 | B2 | * | 8/2005 | Ovadia | 206/6.1 |
| D520,352 | S | * | 5/2006 | Knight et al. | D8/395 |
| 2003/0111583 | A1 | * | 6/2003 | Gaetano | 248/473 |
| 2007/0144921 | A1 | * | 6/2007 | Mobley | 206/6.1 |

* cited by examiner

DISPLAY

CROSS-REFERENCE TO RELATED APPLICATION(S)

The present application claims the priority date of U.S. Provisional Patent Application Ser. No. 60/568,943, filed May 6, 2004.

BACKGROUND OF THE INVENTION

1. Field of the Invention

The present invention relates generally to displays and, more particularly, to a display for holding and displaying objects such as jewelry.

2. Description of the Related Art

It is known to provide displays for objects such as jewelry. One example of such a display is used for holding a ring. The display has a base with a projection extending upwardly and outwardly at an angle from the base in the form of a finger. The ring is disposed on the finger such that the finger extends through an opening defined interiorly by a band of the ring to cause an interference fit with the inner circumference of the band of the ring.

Another example of such a display is disclosed in U.S. Pat. No. 5,855,345 to DiMaggio. In this patent, a display includes a base having a recess, a cylindrical projection extending from the base and into the recess, and a sleeve disposed about the projection. The band of the ring is disposed in the recess and about the projection and sleeve. As the ring is moved toward a rear surface of the recess, the outer circumference of the band contacts a front surface of the recess, and the inner circumference of the band compresses the sleeve to hold the ring against the front surface.

It is desirable to provide a display that better hides ring tags. It is also desirable to provide a display that provides for unlimited angles of display. Thus, there is a need in the art for a display for holding and displaying an object of jewelry such as a ring that maximizes the amount of the ring that can be viewed and the number of ways in which the ring can be positioned and displayed.

SUMMARY OF THE INVENTION

It is, therefore, one object of the present invention to provide a display for holding and displaying objects.

It is another object of the present invention to provide a display for holding and displaying jewelry.

It is yet another object of the present invention to provide a display for holding and displaying rings.

It is still another object of the present invention to provide a display for holding and displaying round and oval objects.

To achieve the foregoing objects, the present invention is a display for holding and displaying an object. The display includes a base and a projection extending from the base and having a slot to form a pair of branches. The branches are adapted to hold a portion of the object within the slot and to display the object.

One advantage of the present invention is that a display is provided for holding an object such as jewelry. Another advantage of the present invention is that the display is used for holding a ring. Yet another advantage of the present invention is that the display maximizes the amount of a ring that can be viewed and hides any price tags attached to the ring, providing an artistic and marketing advantage to the user of the display. Still another advantage of the present invention is that the display maximizes the number of ways in which a ring can be positioned and displayed. A further advantage of the present invention is that the display accommodates very specific floor heights for jewelry showcases. Yet a further advantage of the present invention is that the display can be used for holding and displaying round and oval objects.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
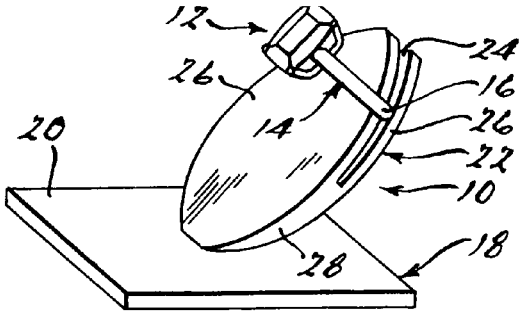
FIG. 1 is a perspective view of a display, according to the present invention, illustrated in operational relationship with an object.
Figure 2:
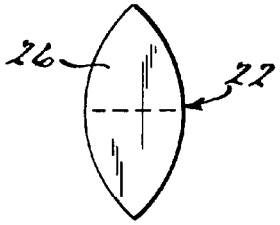
FIG. 2 is an elevational view of a projection of the display of FIG. 1.
Figure 3:
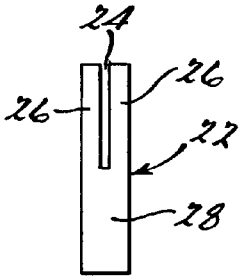
FIG. 3 is a side elevational view of the projection of the display of FIG. 1.
Figure 4:
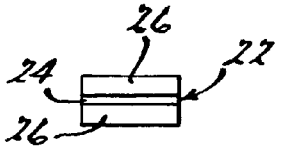
FIG. 4 is a plan view of the projection of the display of FIG. 1.

Referring to the drawings, and in particular FIG. 1, one embodiment of a display 10, according to the present invention, is shown in operational relationship with an object. Although the display 10 is used for holding and displaying any suitable object, such as a piece of jewelry, the display 10 is described below and shown in the figures used in connection with a circular or oval object or a ring, generally indicated at 12. In the embodiment illustrated, the ring 12 has a band, generally indicated at 14, which is generally circular in shape and has an outer circumferential surface 16 and an inner circumferential surface (not shown). It should be appreciated that the band 14 of the ring 12 may be of various shapes and sizes, but has a generally circular shape, as is known in the art.

Figure 7A:
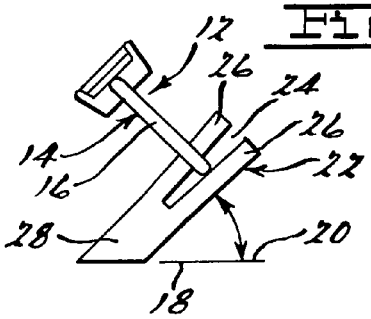
FIGS. 7A and 7B are side elevational views of various angles of the projection of the display of FIG. 1 illustrated in operational relationship with an object.

As illustrated in FIGS. 1 and 7A, the display 10 includes a base, generally indicated at 18, having an upper surface 20. In the embodiment illustrated, the base 18 is generally rectangular, but may be any suitable shape. The base 18 is made of a rigid material, such as plastic. The base 18 may also be made of a transparent material. It should be appreciated that any suitable rigid material may be used to make the base 18.

Figure 5:
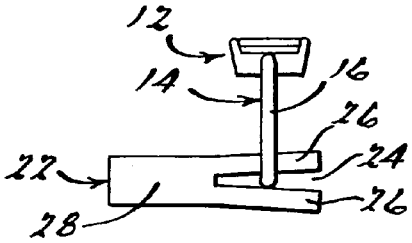
FIG. 5 is a side elevational view of the projection of the display of FIG. 1 illustrated in operational relationship with an object.

As illustrated in FIGS. 1, 5, and 7A, the display 10 also includes a projection, generally indicated at 22, extending from and attached to the base 18 by suitable means, such as being fused to the base 18. As illustrated in FIGS. 1, 3 through 5, and 7A, the projection 22 has a slot 24 to form a pair of branches 26. The slot 24 tapers toward the base 18 such that the branches 26 extend in a non-parallel fashion with respect to each other. The branches 26 are adapted to hold a portion of the ring 12 within the slot 24 and to display the ring 12.

Figure 6A:
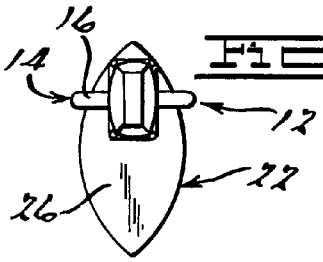
FIGS. 6A and 6B are elevational views of various shapes of the projection of the display of FIG. 1 illustrated in operational relationship with an object.
Figure 6B:
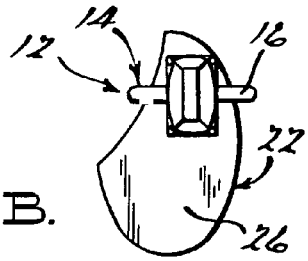
Figure 7B:
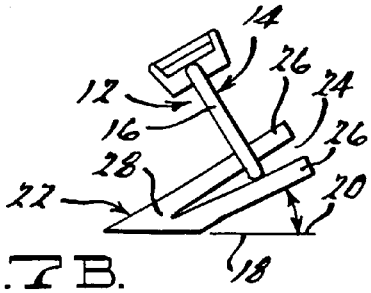

In one embodiment of the display 10, the branches 26 are disposed substantially in the same plane with respect to each other, as illustrated in FIGS. 1, 3 through 5, and 7A. The branches 26 also substantially co-extend with respect to each other and at an angle equal to or fewer than 90° with respect to the upper surface 20 of the base 18, as illustrated in FIGS. 1 and 7. The amount of extent of the branches 26 and, thus, the projection 22 can vary as well as can the angle of inclination of the projection 22 with respect to the base 18. More specifically, the projection 22 can take on any orientation in the continuous range from substantially parallel with to perpendicular to the upper surface 20 of the base 18. For instance, the angle of inclination of the projection 22 with respect to the base 18 can be any between about 45° and 30°, as illustrated in FIGS. 7A and 7B, respectively. In addition, the branches 26 can be disposed at any suitable angle with respect to each other, as illustrated in FIGS. 1, 3 through 5, and 7. As illustrated in FIGS. 6A and 6B, the branches 26 can take on many different suitable sizes and shapes.

As illustrated in FIGS. 1, 3, 5, and 7A, the slot 24 preferably further forms a trunk 28 in the projection 22 disposed between and connecting the base 18 and the branches 26. More specifically, the trunk 28 is integrally connected to the branches 26. As illustrated in FIGS. 7A and 7B, the trunk 28 can vary in size and shape. In another embodiment, the display 10 does not include a trunk 28 such that the branches 26 meet substantially at the upper surface 20 of the base 18.

In one embodiment of the display 10, the projection 22 is made of a semi-rigid material, such as plastic, is non-malleable, and has a sufficient memory when flexed. The projection 22 provides an extremely reliable holding power for various ring-like objects to be held at desired angles and positions.

Although the projection 22 is fused to the upper surface 20 of the base 18, in another embodiment, the projection 22 can have a portion thereof disposed in a cavity (not shown) of the upper surface 20 of the base 18. For example, a portion of the trunk 28 can be disposed in the cavity. In this case, the projection 22 preferably extends from the cavity two to five times longer than the projection 22 is inserted into the cavity. The projection 22 can also be moved to a variety of cavities with no need to replace or add projections 22. Also, many shapes of cavities can utilize many combinations of projections 22. The cavities, especially in transparent-material bases 18, also provide an ornamental appearance. In another embodiment, the projection 22 can be integrally connected to the base 18.

In operation, the band 14 of the ring 12 is disposed about a branch 26. As the ring 12 is moved toward the base 18, a portion of the inner surface of the band 14 contacts a portion of the branch 26 while a portion of the outer surface 16 of the band 14 contacts a portion of the other branch 26 to hold the ring 12 between the branches 26. The ring 12 forms an interference friction fit with the branches 26 due to the outer circumference of each of the branches 26 and the inner surface and outer surface 16 of the ring 12 and the respective surface tensions of the corresponding materials from which the ring 12 and the branches 26 are made. The ring 12 exerts a force upon each of the branches 26, which, in turn, exerts an equal and opposite force upon the ring 12. In combination, the branches 26 hold the ring 12 in place. It should be appreciated that by providing a slot 24 in the projection 22, the tensile strength of the material of the projection 22 creates pressure, thereby locking the ring 12 in place.

By shaping the branches 26 to have substantially pointed shapes, the surface area of the ring 12 being displayed that is unobstructed for viewing can be maximized. By providing the branches 26 to be adapted for disposal at various orientations, the specific orientation at which the ring 12 is displayed for optimal viewing thereof can be achieved as well. In this way, the display 10 maximizes the amount of the ring 12 that can be viewed and the number of ways in which the ring 12 can be positioned and displayed.

The display 10 can be used to hold objects such as jewelry, in general, and rings 12, in particular. Also, the display 10 maximizes the amount of a ring 12 that can be viewed and hides any price tags attached to the ring 12, providing an artistic and marketing advantage to the user of the display 10. Furthermore, the display 10 maximizes the number of ways in which a ring 12 can be positioned and displayed. In addition, the display 10 accommodates very specific floor heights for jewelry showcases. Moreover, the display 10 can be used for holding and displaying round and oval objects.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A jewelry display for holding and displaying a ring comprising:

a base; and a projection contacting and extending from said base at an angle that is non-perpendicular to said base and having a slot tapered toward said base to form a pair of branches that overlap and extend in a non-parallel fashion with respect to each other, said branches being adapted to hold a portion of the ring within said slot and to display the ring, wherein, operatively, as the ring is moved toward said base, a portion of an inner surface of the ring contacts a portion of a first branch of said branches while a portion of an outer surface of the ring contacts a portion of a second branch of said branches to hold the ring between said branches such that the ring forms an interference friction fit with said branches and encloses a part of the first branch such that the jewelry is disposed over one of said branches and extends outwardly in a non-parallel fashion with respect to the slot.

2. A jewelry display as set forth in claim 1 wherein said branches are disposed substantially in the same plane with respect to each other.

3. A jewelry display as set forth in claim 1 wherein said branches extend at an angle less than 90° with respect to said base.

4. A jewelry display as set forth in claim 3 wherein said branches extend at any angle between about 30° and about 45° relative to said base.

5. A jewelry display as set forth in claim 1 wherein said slot further forms a trunk of said projection, wherein said trunk extends substantially in the same plane as said branches and is disposed between and connects said base and said branches.

6. A jewelry display as set forth in claim 1 wherein said projection is made of a semi-rigid material having a sufficient memory when flexed.

7. A jewelry display for holding and displaying jewelry comprising:

a base; and an arcuate shaped projection contacting and extending from said base at an angle that is non-perpendicular to said base and having a slot tapering toward said base to form a pair of branches, wherein said branches overlap and substantially co-extend outwardly in a non-parallel fashion with respect to each other at an angle from said base and are disposed substantially in the same plane with respect to each other, said branches being adapted to hold a portion of the jewelry within said slot and to display the jewelry, wherein, operatively, as the jewelry is moved toward said base, a portion of an inner surface of the jewelry contacts a portion of a first branch of said branches while a portion of an outer surface of the jewelry contacts a portion of a second branch of said branches to hold the jewelry between said branches such that the jewelry forms an interference friction fit with said branches and encloses a part of the first branch such that the jewelry is disposed over one of said branches and extends outwardly in a non-parallel fashion with respect to the slot.

8. A jewelry display as set forth in claim 7 wherein said branches substantially co-extend at any angle between about 30° and about 45° relative to said base.

9. A jewelry display as set forth in claim 7 wherein said projection includes a trunk extending substantially in the same plane as said branches and disposed between and connecting said base and said branches.

10. A jewelry display as set forth in claim 7 wherein said projection is made of a semi-rigid material and has a sufficient memory when flexed.

11. A jewelry display for holding and displaying a ring comprising:

a base; and a projection extending from said base, said base having ends and a central portion between said ends, said central portion having a width greater than a width of said ends, said projection and having a slot tapered from one of said ends farthest from said base to another of said ends connected to said base to form a pair of branches such that said branches overlap and extend in a non-parallel fashion with respect to each other and a trunk extending substantially in the same plane as said branches and disposed between and connecting said base and said branches at an angle that is non-perpendicular to said base, said branches being adapted to hold a portion of the ring within said slot and to display the ring, wherein, operatively, as the ring is moved toward said base, a portion of an inner surface of the ring contacts a portion of a first branch of said branches while a portion of an outer surface of the ring contacts a portion of a second branch of said branches to hold the ring between said branches such that the ring forms an interference friction fit with said branches and encloses a part of the first branch such that the ring is disposed over one of said branches and extends outwardly in a non-parallel fashion with respect to the slot.

12. A jewelry display as set forth in claim 11 wherein said branches are disposed substantially in the same plane with respect to each other.

13. A jewelry display as set forth in claim 11 wherein said branches extend at an angle fewer than 90° with respect to said base.

14. A jewelry display as set forth in claim 13 wherein said branches extend at any angle between about 30° and 45° relative to said base.

15. A jewelry display as set forth in claim 11 wherein said projection is made of a semi-rigid material, is non-malleable, and has a sufficient memory when flexed.

* * * * *